United States Patent [19]

Beutler et al.

[11] 4,125,371

[45] Nov. 14, 1978

[54] PROCESS FOR THE LEVEL, ISOTHERMAL HIGH-TEMPERATURE DYEING OF HYDROPHOBIC SYNTHETIC FIBERS WITH DISPERSE DYESTUFFS

[75] Inventors: Helmut Beutler; Joachim W. Lehmann, both of Kelkheim, Taunus, Fed. Rep. of Germany

[73] Assignee: Hoechst Aktiengesellschaft, Frankfurt am Main, Fed. Rep. of Germany

[21] Appl. No.: 710,139

[22] Filed: Jul. 30, 1976

[30] Foreign Application Priority Data

Aug. 2, 1975 [DE] Fed. Rep. of Germany ..... 2534562

[51] Int. Cl.[2] ..... D06P 3/00; D06B 23/24; D06B 23/28

[52] U.S. Cl. ..... 8/176; 8/26; 8/39 C; 8/41 C; 8/148; 8/154; 8/158

[58] Field of Search ..... 8/148, 158, 176

[56] References Cited

U.S. PATENT DOCUMENTS

| | | | |
|---|---|---|---|
| 3,807,872 | 4/1974 | Pronier | 356/181 |
| 3,867,040 | 2/1975 | Loffler et al. | 356/181 |
| 4,089,644 | 5/1978 | Carbonell et al. | 8/1 R |

FOREIGN PATENT DOCUMENTS

| | | |
|---|---|---|
| 802,499 | 1/1974 | Belgium. |
| 2,256,116 | 5/1973 | Fed. Rep. of Germany. |
| 2,359,726 | 6/1975 | Fed. Rep. of Germany. |
| 531,442 | 10/1976 | Fed. Rep. of Germany. |
| 7,308,295 | 12/1973 | Netherlands. |
| 1,270,988 | 4/1972 | United Kingdom. |
| 1,450,216 | 9/1976 | United Kingdom. |

OTHER PUBLICATIONS

Webster's Seventh New Collegiate Dictionary (Merriam Co.), 1965, p. 897.

*Primary Examiner*—A. Lionel Clingman
*Attorney, Agent, or Firm*—Curtis, Morris & Safford

[57] ABSTRACT

Exhaust process for the isothermal high-temperature dyeing of textile material made of hydrophobic synthetic fibers in a closed dyeing system with water-insoluble disperse dyestuffs, according to which the disperse dyestuff predispersed in water of 40° to 60° C is introduced into the aqueous bath free of dyestuff that is already circulating and heated together with the material to a dyeing temperature within the range of from 115° to 140° C and adjusted to pH 4 – 6, which comprises evaluating the number of the bath circulations per minute by measuring it and the amount of dyestuff exhausted onto the fiber at the same time, and introducing the predispersed dyestuff in doses into the dyebath, depending on the obtained measuring values.

6 Claims, No Drawings

PROCESS FOR THE LEVEL, ISOTHERMAL HIGH-TEMPERATURE DYEING OF HYDROPHOBIC SYNTHETIC FIBERS WITH DISPERSE DYESTUFFS

The present invention relates to a process for the level, isothermal high-temperature dyeing of hydrophobic synthetic fibers with disperse dyestuffs.

The German Auslegeschrift No. 2,235,110 describes a process for the high-temperature dyeing of hydrophobic fibers with water-insoluble disperse dyestuffs in which the dyebath consisting just of water adjusted to pH 4 - 6, is heated together with the goods to the dyeing temperature within the range of from 115° - 140° C. In a separate batch vessel, the dyestuff is meanwhile predispersed, as usual, in water having a temperature within the range of from 40° C to 60° C. Then, the dispersion is introduced into the hot dyebath in a single batch via an additional pocket or an injector.

Subject matter of the German Offenlegungsschrift No. 2,256,116 is also the isothermal dyeing of textile material made of polyester fibers with disperse dyestuffs, a process in which the dyestuffs are introduced into the dyebath only at the dyeing temperature. Also in this process known in the art the dyestuffs used must be predispersed in the respective dyeing medium.

A further process for the isothermal dyeing of hydrophobic organic polyester material in which a bath circulating through the material is used, is known from the German Offenlegungsschrift No. 2,330,622. In this process, the dyestuffs entirely or nearly free of dispensing agents are suspended in water heated to 90° - 95° C. When still being separated from the dyeing system, the suspension is heated to the dyeing temperature and then introduced into the dyeing system consisting of dyebath and water. As taught in the above-mentioned Offenlegungsschrift, the dyestuff must be pretreated also in this case which is about the same as a predispersion.

According to all the above methods known in the art, the dyestuff predispersed or prepared in any other manner is introduced in a single batch into the dyeing system heated to dyeing temperature. This operational method involves disadvantages as to the safety and levelness of the dyeing for the following reasons:

For an optimum passage rate of the bath through the dyeing material and a constant dyeing temperature, in case of one bath circulation, i.e. the time in which the total dyebath available is pumped once through the dyeing material, 2% at most of the dyestuff contained in this dyebath exhaust onto the dyeing material. Generally about 50 circulations are necessary for the entire exhaustion of the dyestuff from the dyebath. This means, for example, that one circulation per minute makes up to 50 minutes to exhaust the dyebath. In four circulations/min about 4 × 2% (= 8%) in one minute of the dyestuff available are exhausted, so that the whole exhaustion process takes not more than about 13 minutes.

The experimental amount of 2% is largely independent of the fact whether fair or dark dyeings are prepared, i.e. whether a small or a large dyestuff amount is used.

In the case of a dyeing prepared with for example 3% of dyestuff, calculated on the weight of the material, 2% of this dyestuff amount, i.e. 0.06% of dyestuff, calculated on the weight of the material, are exhausted after one bath circulation. When the circulation pump and the density of the packed material allow four bath circulations/min, 8% of the dyestuff available or 0.24% of dyestuff calculated on the weight of the material are exhausted on the fiber after these four circulations.

When only 1% of dyestuff, calculated on the weight of the material is used for dyeing, the bath exhaustion is maintained at about 2% per circulation. After one circulation 0.02% of dyestuff, calculated on the weight of the material, is exhausted which makes for four circulations 8% of the total dyestuff available or an exhaustion of 0.08% of dyestuff calculated on the weight of the material.

As a consequence, the time the dyestuff needs for exhaustion can be reduced by increasing the number of bath circulations per time unit, i.e., circulation/min. This can be achieved by increasing the pumping capacity. If in this way for example the number of bath circulations/min is tripled, the exhaustion time of the dyestuff can be reduced to a third. But dyeing must be continued for a certain time to allow dyestuff diffusion into the fiber, which is decisive for the quality of the dyeing. The reduced periods of exhaustion and heating give the principle of the preceding processes known in the art. But they have still reat great When according to the processes mentioned above the total amount of dyestuff is introduced into the dyebath in a single batch, it must be maintained as a stable dispersion over a period of time of 15 to 30 minutes or more, depending on the passage rate of the bath. But the high dyeing temperatures reached favor the breaking tendency of the dispersion. Likewise, the tendency to crystallization of the disperse dyestuffs under these conditions is embarrassing. When the point where dyestuff crystallization starts is reached, deposits of the crystallized dyestuff on the fiber material are inevitable and form quickly. Unlevel dyeings without fastness to abrasion are obtained.

When dyestuff combinations are used in which the components do not entirely correspond as to their coloristical properties, unlevel dyeings may be obtained when the total dyestuff dispersion is introduced all at once at dyeing temperature.

The present invention provides a process for the isothermal high-temperature dyeing of textile materials made of hydrophobic synthetic fibers in a closed dyeing system with water-insoluble disperse dyestuffs according to the exhaustion method which eliminates all the interference factors described above and has a favorable influence on the levelness of the dyeings. The new process allows to obtain shades which can be dyed only with utmost difficulty in satisfactory levelness, for example brown or grey shadings, which have to be dyed generally with combinations of dyestuffs that have a different coloristic behavior.

The principle of the present invention, according to which the disperse dyestuff predispersed in a determined amount of warter of 40° to 60° C is introduced into the aqueous bath free of dyestuff and which is already circulating together with the material heated to a dyeing temperature within the range of from 115° to 140° C, preferably 120° to 135° C, and is adjusted to pH 4–6, especially lies in the fact that the passage rate and thus the bath circulations per minute are evaluated by means of suitable measuring instruments and depending thereon and on the amount of dyestuff exhausted onto the fiber at the same time, the dyestuff dispersion is introduced into the dyebath in doses. So, it is possible, according to the invention, to add just the dosed amount that is actually exhausted in each bath circulation. On that basis, the total dyestuff to be used can be added in doses (depending on the liquor passage rate) in accordance with a particular frequency of addition, or it can be added continuously over a prolonged period of time, i.e., while a greater number of bath circulations takes place, thus allowing the dyestuff to be added in accordance with the evaluated unit (bath circulations/-min). The dosage can be effected discontinuously or continuously and can be controlled by electronic means.

The conditions laid down in the German Auslegeschrift No. 2,235,110 proved to be especially suitable for the process according to the invention. The following is a detailed description of the process:

The total amount of disperse dyestuff is dispersed in a determined amount of water of 40° - 60° C. Thus, the concentration of the predispersion is predetermined. A predispersion is meant to be the form of preparation adequate for the dyestuff to be added to the dyebath. Its amount can be calculated quantitatively or on a determined concentration of the dyestuff. In the first case, independent of the amount of dyestuff used, always the same volume of predispersion is used, in the second case always the same dyestuff concentration is adjusted. So, a high amount of dyestuff corresponds to a big volume of the predispersion and a small amount of dyestuff to a smaller volume of the predispersion.

In the process of the invention, the quantitative standard is suitably chosen because then the dosage device has to be adjusted only once for an unvarying amount and dosage can be effected by merely measuring the volume. Besides, in preparing the batch, the dyebath can be calculated such that the introduction of the additional volume of the predispersion into the dyeing apparatus is taken into account.

Dispersions of a temperature ranging from 40° to 60° C are extraordinarily stable and do not tend to crystallize the dyestuff. When the predispersions are prepared at dyeing temperature, i.e. 115° - 140° C, or are heated to that temperature afterwards, one risks the possibility of crystallization of the dyestuff material. Moreover, the preparation of those predispersions requires pressurized reaction vessels which are not necessary when the predispersions are prepared at 40° - 60° C.

While preparing the predispersion, the dyebath (which consists of water adjusted to pH 4 - 6 with acetic acid) is heated together with the material to a dyeing temperature within the range of from 115° - 140° C and brought to circulation. A measuring device evaluates the liquor passage rate, i.e. the number of bath circulations/min and depending on the measured value obtained and calculated thereupon, a portion of the predispersion (and so a determined portion of total dyestuff) is pumped into the circulating bath via the injector which advantageously has an electronic link with the measuring device. As the liquor passage rate is evaluated directly, the measuring device does not depend on the density of the packed material and the nature of the material to be dyed, or on a pumping rate which might vary. These factors which influence the number of the bath circulations/min are eliminated by relying upon the direct measurement.

After a certain time which can be chosen and is adjustable in an electronic device, a second calculated part amount of the predispersion is introduced into the dyebath.

This operation is repeated as required until the total predispersion is introduced into the dyebath. This means that the predispersion is introduced at a specific rate, for example after ½, 1 or 1½ minutes, etc., in portions, the periodically introduced volumes depending directly on the number of bath circulations determined over a preselected period of time, e.g. 1 minute and on the fact that during a single bath circulation approximately 2% of the total dyestuff are to be introduced, which corresponds to 2% of the predispersion.

The following Table illustrates the coherence between liquor passage rate (bath circulations/min), determinable rate of introduction and amount of predispersion in % of its total amount to be introduced per addition and contains values concerning the duration of the introduction period and the complete dyeing period.

TABLE

| Bath circulations per minute | Introduction rate minutes 0.5 | 1 | 1.5 | 2 | Duration of the introduction period min. approximately | Complete dyeing period min. approximately |
|---|---|---|---|---|---|---|
| 4 | 4 % | 8% | 12 % | 16% | 13 | 25 - 40 |
| 3 | 3 % | 6% | 9 % | 12% | 17 | 30 - 50 |
| 2.5 | 2.5% | 5% | 7.5% | 10% | 20 | 30 - 50 |
| 2 | 2 % | 4% | 6 % | 8% | 25 | 30 - 50 |
| 1.5 | 1.5% | 3% | 4.5% | 6% | 35 | 40 - 60 |
| 1 | 1 % | 2% | 3 % | 4% | 50 | 50 - 60 |
| Column 1 | 2 | 3 | 4 | 5 | 6 | 7 |

Columns 2 to 5 indicate the portion of predispersion in % of total amount to be introduced per addition into the dyebath.

These values also apply to predispersions made up to constant dyestuff concentrations.

Since the passage rate is generally hardly changed in the course of the dyeing period, it is generally sufficient to calculate only once the portion from the measured value and the desired introduction rhythm for the dyeing in question. Then, in the rhythm determined in advance the unvaried portion of predispersion is pumped into the dyebath until its entire comsumption.

After the introduction period is finished, dyeing must be continued for 10 - 20 minutes at the dyeing temperature to allow the dyestuff to be exhausted by the fiber, which fact is taken into account in the values listed in column 7. The Table shows that for passage rates of only one or one and a half bath circulation/min no considerable decrease of the dyeing period is to be expected.

Nevertheless, there is still the advantage of a shorter heating time and of obtaining a more level dyeing. For these liquor passage rates, the dyeing period for the exhaustion of the dyestuff following the introduction period needs to be only 5 to 10 minutes because there is sufficient dyestuff penetration already during the introduction period.

In continuous operation, the injector pump which pumps the predispersion into an electronic dyebath is controlled by the passage rate measuring device in such a way that, per bath circulation, 2% of the predispersion are introduced into the dyebath.

It was surprising that the process of the invention can improve the levelness of the dyeings, since it has been known until now that fair dyeings, i.e. dyeings for which less dyestuff is used, involve the greater risk to become unlevel. As at the beginning of the introduction period only portions of the total dyestuff are introduced, unlevel dyeings are more likely to be obtained immediately when starting the dyeing operation as long as only a small amount of dyestuff is introduced into the dyebath. A further advantage over the processes hitherto known of the process of the invention is that the addition of the predispersion does not cause heavy temperature oscillations of the heated dyebath. This risk is run when the total 40° - 60° C hot predispersion is added only once, the breaking of the dispersion in the dyebath and so faulty dyeings being possible. When only portions of the predispersion are introduced into the dyebath, the minimum temperature oscillation resulting therefrom can be balanced immediately.

During the whole dyeing period, the direction of the circulating dyebath is changed at the usual intervals.

The practicability of the process does not depend on a determined device, it can be carried out manually by measuring the number of te bath circulations per minute and by pumping determined part amounts of predispersion depending on the measured passage rate into the dyebath at determined intervals by switching on the injector. However, electronic control is preferred because of its ability to avoid errors.

The following Examples serve to illustrate the principle of the process of the invention but do not limit it to certain devices.

EXAMPLE 1

A 1,000 l high-temperature beam dyeing apparatus provided with passage rate measuring device and injector is fed with 100 kg of knitted fabric made of texturized polyester fibers wound on a beam and filled with about 950 l of warm water. The pH value of the bath is adjusted to 5 with acetic acid and the circulating dyebath heated to 135° C.

Meanwhile 1.5 kg of the yellow-brown disperse dyestuff of the formula

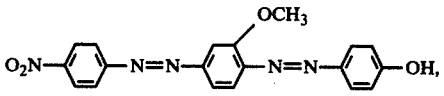

0.45 kg of the red disperse dyestuff of the formula

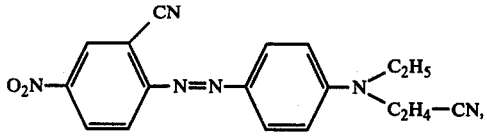

and 0.65 kg of a blue disperse dyestuff consisting of a mixture of approximately equal parts of the dyestuffs of the formulae

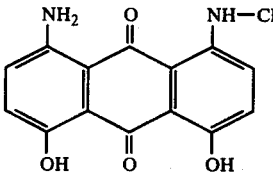

and

-continued

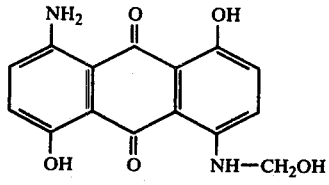

(all dyestuffs in commerical form and condition) are dispersed in 50 l of warm water of 45° C in the batch vessel.

This dispersion is to be added to the dyebath portionwise using a 1-minute introduction basis.

The passage rate measuring instrument indicates a passage rate value of 2,500 l/min which corresponds to 2.5 bath circulations/min.

The dispersion is introduced into the dyebath by means of the injector. During the introduction operation, 5% of the dispersion bath is introduced per minute, that is 5% of 50 = 2.5 l. The introduction is effected in the same manner every minute, 20 times in total, whereafter the batch is entirely introduced.

The textile material is dyed for another 15 minutes at 130° C, the dyebath is withdrawn, and the material is rinsed with hot water; the dyeing is after-treated under reductive conditions in caustic alkaline medium in the usual manner.

After a total dyeing period of 35 minutes (time for preparing and after-treating not counted in) a brown dyeing of complete levelness and good penetration of the dyestuff through the material is obtained.

EXAMPLE 2

A 2,000 l high-temperature beam dyeing apparatus provided with injector and passage rate measuring device electronically joined thereto is fed with 170 kg of texturized polyester yarn in the form of muffs and filled with about 1950 l of hot water. The bath is adjusted to pH 5 with acetic acid and 2% (calculated on the material weight) of ammonium sulfate, and circulation is started. Heating to 135° C is effected as quickly as possible.

Meanwhile 170 g of the yellow disperse dyestuff of the formula

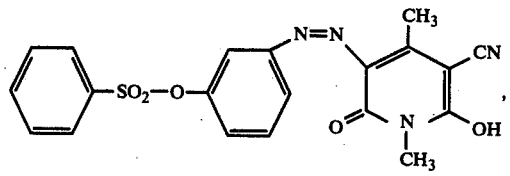

170 g of the red disperse dyestuff of the formula

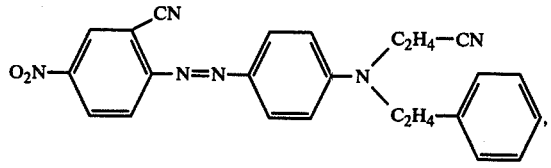

and 170 g of the red disperse dyestuff of the formula

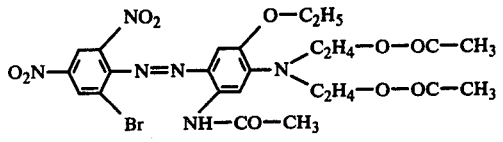

(all dyestuffs in commerical form and condition) are dispersed in the batch vessel, in 50 l of water heated to 50° C.

The passage rate measured is 3 bath circulations/min.

Therefore, the dispersion is to be introduced continuously within 17 minutes depending on the passage rate.

The injector is automatically controlled in such a way that 6% of the batch or 3 l of the dispersion are pumped in a minute out of the batch vessel into the circulating bath. After about 17 minutes the bath is entirely introduced and the injector is switched off.

The material is continued to be dyed at 130° C during 20 minutes and the hot bath is withdrawn. The dyeing is after-treated at 70° C for 10 minutes with an aqueous bath containing 2 $cm^3$/l of acetic acid (60%) and 0.2 g/l of the reaction product of 1 mol of castor oil with 36 mols of ethylene oxide.

Then, the dyed textile material is rinsed and dried.

For a color intensity even so little, the beige dyeing obtained is entirely level.

What is claimed is:

1. A process for the isothermal high-temperature dyeing of textile material made of hydrophobic synthetic fibers in a closed dyeing system with water-insoluble disperse dyestuffs according to the exhaustion method, according to which the disperse dyestuff predispersed in water of 40° to 60° C is introduced into an aqueous bath free of dyestuffs which is already circulating to form a bath liquor, and heated together with the textile material to a dyeing temperature within the range of from 115° C to 140° C and adjusted to pH 4 – 6, which comprises measuring the bath liquor circulation rate and the amount of dyestuff exhausted onto the fiber, and introducing the predispersed dyestuff in doses into the dye bath liquor depending on the measured rate and the amount of dyestuff exhausted to replace the dyestuff exhausted such that 1% to 4% of the total dyestuff to be introduced is added per one bath liquor circulation.

2. A process as in claim 1 wherein the dispersed dyestuff is dispersed in a given volume of water to form a dispersion and dosage is effected by injecting a preselected volume of the dispersion into the dyebath.

3. A process as in claim 1 wherein the dispersed dyestuff is dispersed to form a dispersion of a desired dyestuff concentration and dosage is effected by injecting a preselected volume of the dispersion into the dyebath.

4. A process as claimed in claim 1, wherein the predispersed disperse dyestuff is dosed continuously.

5. A process as claimed in claim 1, wherein the predispersed dyestuff is added to the dyebath intermittently.

6. A process as claimed in claim 1, wherein injection of the dosage is effected under electronic control.

* * * * *